United States Patent [19]

Masaki

[11] 4,051,673

[45] Oct. 4, 1977

[54] AUTOMOTIVE INTERNAL COMBUSTION ENGINE

[75] Inventor: Kenji Masaki, Yokohama, Japan

[73] Assignee: Nissan Motor Company, Limited, Yokohama, Japan

[21] Appl. No.: 610,390

[22] Filed: Sept. 4, 1975

[30] Foreign Application Priority Data

Sept. 19, 1974 Japan ..... 49-108081

[51] Int. Cl.[2] ..... F02B 75/10

[52] U.S. Cl. ..... 60/282; 123/52 M; 123/59 PC; 123/127; 123/148 DS

[58] Field of Search ..... 60/282, 274, 285; 123/148 E, 148 DS, 52 R, 52 M, 127, 59 PC

[56] References Cited

U.S. PATENT DOCUMENTS

| | | | |
|---|---|---|---|
| 2,367,023 | 1/1945 | Horton | 123/148 DS |
| 3,121,422 | 2/1964 | Baker | 123/52 M |
| 3,827,237 | 8/1974 | Linder | 60/285 |
| 3,934,411 | 1/1976 | Masaki | 60/282 |

*Primary Examiner*—Douglas Hart

[57] ABSTRACT

A spark-igniton multiple-cylinder internal combustion engine for an automotive vehicle, having a first set of cylinders to operate on a relatively lean air-fuel mixture and a second set of cylinders to operate on a relatively rich air-fuel mixture, wherein improvement is made so that the power outputs of each of the first set of cylinders and each of the second set of cylinders are substantially equalized with or at least made closer to each other.

14 Claims, 7 Drawing Figures

AUTOMOTIVE INTERNAL COMBUSTION ENGINE

The present invention relates in general to internal combustion engines for automotive vehicles and, particularly, to a spark-ignition multiple-cylinder internal combustion engine having an exhaust emission control arrangement.

With a view to reducing toxic combustible residues such as unburned hydrocarbons and carbon monoxide contained in the exhaust gases from automotive internal combustion engines, some modernized automotive vehicles are equipped with thermal reactors which are adapted to re-combust or "afterburn" the exhaust emissions before the exhaust gases are discharged to the open air. In an attempt to exploit the exhaust cleaning performance of such emission control devices and to lessen not only the hydrocarbons and carbon monoxide but nitrogen oxides which are other major contributors to air pollution caused by automotive vehicles, it has been proposed to have the cylinders of the engine arranged in two groups and to supply a relatively rich combustible mixture to one group of cylinders and a relatively lean combustible mixture to the other group of cylinders. Experiments have revealed that an internal combustion engine of this nature is successful in gaining the object of cleaning the exhaust gases when the former group of cylinders (herein referred to as rich-mixture cylinders) is supplied with a combustible mixture having an air-to-fuel ratio within the range of from about 10:1 to about 13:1 and the latter group of cylinders (hereinafter referred to as lean-mixture cylinders) is supplied with a combustile mixture having an air-to-fuel ratio within the range of from about 18:1 to about 21:1. The exhaust gases from the rich-mixture cylinders and the exhaust gases from the lean-mixture cylinders are mixed together in the thermal reactor so that the toxic combustible residues contained in higher proportion in the former are re-oxidixed with the agency of hot air contained with a higher concentration in the latter.

The horsepower output of the an engine cylinder is in general markedly affected by the air-to-fuel ratio of the combustible mixture supplied to the cylinder as is well known in the art and decreases over a broad range when the combustible mixture supplied to the cylinder is made leaner, viz., the air-to-fuel ratio is made higher. If, therefore, two groups of engine cylinders are supplied with combustible mixtures having different air-to-fuel ratios as in the internal combustion engine of the described character, the total power output of the engine tends to fluctuate remarkably and product unusual vibrations which are causative of, for example, localized abrasion and wear of the various bearings and other sliding members incorporated into or associated with the engine although the performance characteristics of the engine per se will not be crucially deteriorated. The present invention contemplates elimination of these drawbacks inherent in prior art multiple-cylinder internal combustion engines having rich-mixture and lean-mixture cylinders and a thermal reactor in the exhaust system.

It is, accordingly, an object of the present invention to provide an improved multiple-cylinder internal combustion engine having rich-mixture and lean-mixture cylinders which are arranged or with which an arrangement is made so that the respective horsepower outputs of the individual cylinders are substantially equalized so as to smooth out the total power output of the engine and to preclude production of unusual vibrations that would otherwise be created when the engine cylinders are supplied with combustible mixtures having different air-to-fuel ratios.

Improvements according to the present invention are, thus, made in an automotive spark-ignition multiple-cylinder internal combustion engine having a first set of cylinders connected to first mixture induction means operative to supply each of the first set of cylinders with a combustible mixture leaner than a stoichiometric mixture (which has an air-to-fuel ratio of 14.8 : 1 by weight), a second set of cylinders connected to second mixture induction means operative to supply each of the second set of cylinders with a combustible mixture richer than the stoichiometric mixture, and an exhaust system including exhaust recombustion means provided for re-combusting the mixture of the exhaust gases from the first and second sets of cylinders. Each of the mixture induction means above mentioned may comprise a carburetor which is connected to each of the first and second sets of cylinders or to each of the cylinders or may comprise a fuel injection system associated with each of the first and second sets of cylinders.

In accordance with a first important aspect of the present invention, the first and second sets of cylinders of the above mentioned internal combustion engine are so sized that each of the first set of cylinders (viz., the lean-mixture cylinders) has a bottom-dead-center (BDC) volume larger than the bottom-dead-center volume of each of the second set of cylinders (viz., the rich-mixture cylinders) whereby the power output of the former is substantially equal to the power output of the latter. The term"bottom-dead-center volume" herein referred to means the internal volume of an engine cylinder with the piston at the bottom dead center position of the cylinder bore.

In accordance with a second important aspect of the present invention, the first and second sets of cylinders of the engine of the above described general nature are constructed and arranged so that each of the first set of cylinders has a compression ratio which is higher than the compression ratio of each of the second set of cylinders whereby the power output of the former is substantially equal to the power output of the latter. In this instance, it is preferable that each of the first set of cylinders has a stroke measurement substantially equal to the stroke measurement of each of the second set of cylinders but has a clearance volume (which is the volume above the piston at the top-dead-center position) smaller than the clearance volume of each of the second set of cylinders.

In accordance with a third important aspect of the present invention, the first and second sets of cylinders of the internal combustion engine having the basic construction and arrangement previously described are provided with first and second spark-ignition units, respectively, wherein the first ignition unit is arranged to provide spark-advance characteristics enabling each of the first set of cylinders to produce a power output approximating maximum power output of the cylinder and the second ignition unit is arranged to provide spark-advance characteristics producing ignition timing retarded from the ignition timing dictated by spark-advance characteristics which will provide maximum power output of each of the second set of cylinders.

The respective features according to the above outlined first, second and third important aspects of the present invention may be incorporated either independently or in combination into the internal combustion engine of the general character previously described depending upon the type and make of the engine and/or the desired exhaust cleaning characteristics and efficiency. Such features of the present invention and combinations of the features will be more clearly understood from the following description taken in conjunction with the accompanying drawings, in which:

FIG. 1 is a schematic top plan view, partly in section, of a known internal combustion engine having lean-mixture and rich-mixture cylinders and a thermal reactor in the exhaust system;

FIG. 2 is a graph showing general tendencies of variation, with respect to the air-to-fuel ratio of a combustible mixture, of the quantities in grams per horsepower per hour of carbon monoxide CO (indicated by curve *a*) and nitrogen oxides $NO_x$ (indicated by curve *b*) contained in exhaust gases from a representative internal combustion engine and the horsepower output (indicated by curve *c*) available with the air-to-fuel ratio;

Figure 1:
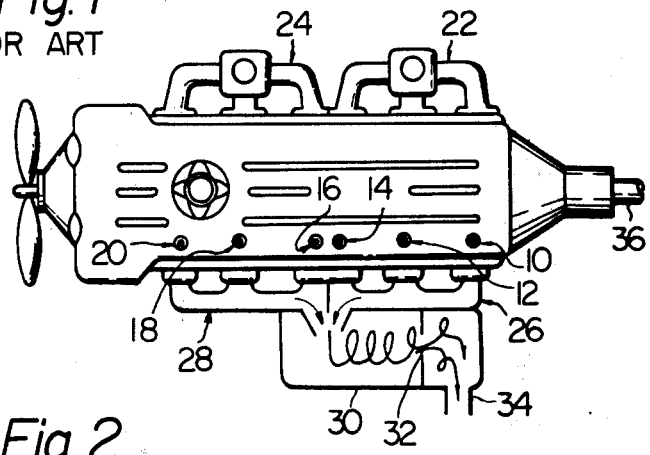
Fig. 1 PRIOR ART
Figure 2:
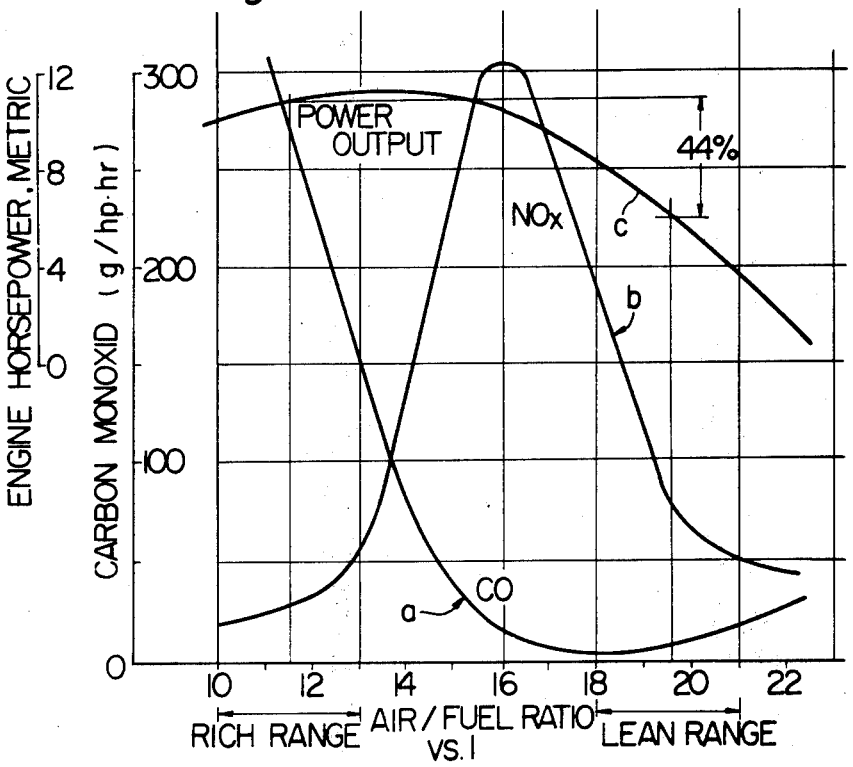

Referring to FIG. 1, a prior art multiple-cylinder internal combustion engine comprises a first set of cylinders 10, 12 and 14 and a second set of cylinders 16, 18 and 20 which are all diagrammatically illustrated. The first set cylinders 10, 12 and 14 are assumed to be the lean-mixture cylinders and are jointly connected by way of an intake manifold 22 to first mixture induction means such as a carburetor (not shown) arranged to form a relatively lean combustible mixture having an air-to-fuel ratio of, for example, about 18:1 to about 21:1. The second set of cylinders 16, 18 and 20 are assumed to be the rich-mixture cylinders and are jointly connected by way of an intake manifold 24 to second mixture induction means such as a carburetor (not shown)) arranged to form a relatively rich combustible mixture having an air-to-fuel ratio of, for example, about 10:1 to about 13:1. The first set of cylinders 10, 12 and 14 is thus adapted to reduce the concentration of the combustible residues of, for example, hydrocarbons and carbon monoxide in the exhaust gases emitted therefrom whilst the second set of cylinders 16, 18 and 20 is adapted to inhibit formation of nitrogen oxides in the exhaust gases emitted therefrom, as will be understood from the curves *a* and *b* of FIG. 2. In FIG. 2, the relationship between the quantity of hydrocarbons and the air-to-fuel ratio is not illustrated but will be analogized from the curve *a* which indicates the variation in the concentration of carbon monoxide with the air-to-fuel ratio.

Turning back to FIG. 1, the first and second sets of engine cylinders have respective exhaust manifolds 26 and 28 which merge into a common exhaust re-combustion chamber 30 constituting a thermal reactor. The exhaust re-combustion chamber 30 has an outlet port 32 which is in constant communication with an exhaust pipe 34. The exhaust pipe 34 is led to the open air through a muffler or mufflers and a tail pipe, though not shown in the drawings but as is customary in the usual exhaust system of an automotive internal combustion engine. The exhaust gases emitted from the lean-mixture cylinders 10, 12 and 14 and the exhaust gases emitted from the rich-mixture cylinders 16, 18 and 20 are thus admitted through the respective exhaust manifolds 26 and 28 into the exhaust re-combustion chamber 30 during exhaust stroke of each of the cylinders. The combustible residues of hydrocarbons and carbon monoxide contained in greater proportion in the exhaust gases from the rich-mixture cylinders 16, 18 and 20 are consequently re-oxidized with the agency of hot air which is contained in greater proportion in the exhaust gases from the lean-mixture cylinders 12, 14 and 16. Designated by reference numeral 36 is a crankshaft to which the pistons in the above mentioned cylinders are jointly connected.

As will be understood from the curve *c* of FIG. 2, the power output, expressed as metric horsepower output of an internal combustion engine or each of the cylinders incorporated into the engine decreases over a broad range as the air-to-fuel ratio of a combustible mixture supplied thereto increases or, in other words, the combustible mixture is leaned out. The horsepower outputs delivered from the individual cylinders of the prior art multiple-cylinder internal combustion engine constructed and arranged in the above described fashion therefore vary markedly between the first set of cylinders 10, 12 and 14 and the second set of cylinders 16, 18 and 20 because of the difference between the air-to-fuel ratios of the combustible mixtures supplied to the two groups of cylinders. If, for example, the air-to-fuel ratio of the combustible mixture supplied to each of the first set of cylinders 10, 12 and 14 is set at about 19.5:1 and the air-to-fuel ratio of the combustible mixture supplied to each of the second set of cylinders 16, 18 and 20 is set at about 11.5:1, then the horsepower output of each of the lean-mixture cylinders 10, 12 and 14 is lower by approximately 44 percent than the horsepower output of each of the rich-mixture cylinders 16, 18 and 20 as will be evident from the curve *c* of FIG. 2. Such a difference between the power outputs of the individual cylinders causes unusual vibrations in the engine and in the result gives rise to various serious problems which are not encountered in usual multiple-cylinder internal combustion engines as previously noted. As previously noted, the goal of the present invention is to eliminate these problems inherent in prior art internal combustion engines of the described character.

Figure 3A:
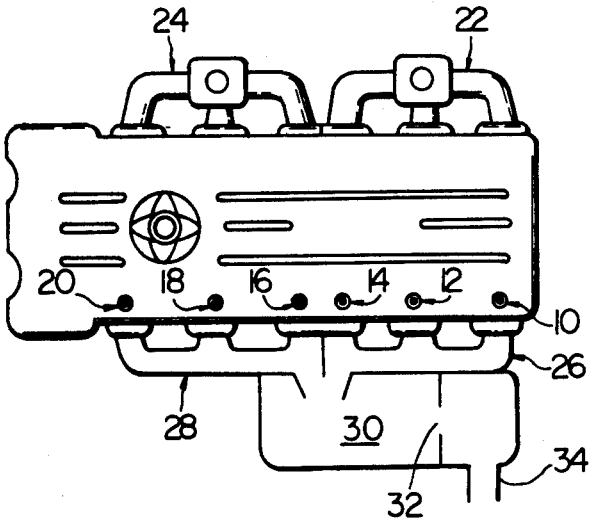
FIG. 3A is a schematic top plan view of a multiple cylinder internal combustion engine incorporating an improvement according to the present invention.
Figure 3B:
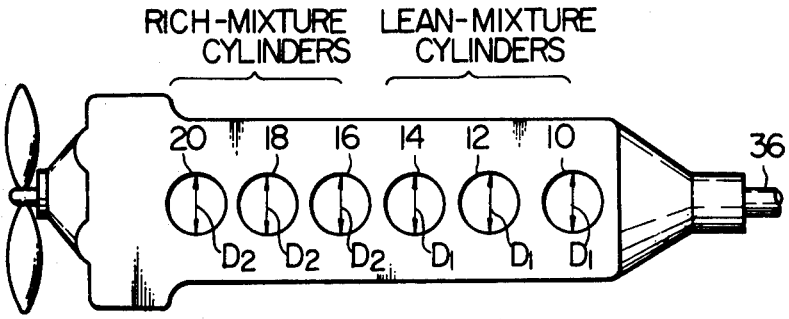
FIG. 3B is a schematic view showing a general arrangement of cylinders of the internal combustion engine illustrated in FIG. 3A.

The power output of an engine cylinder varies substantially in direct proportion to the quantity of air consumed in each cycle of operation of the cylinder. This will suggest that the power output of an engine cylinder can be augmented by increasing the internal volume, more exactly the bottom-dead-center volume as previously defined, of the cylinder. FIGS. 3A and 3B illustrate an embodiment of the multiple-cylinder internal combustion engine carrying out such a scheme. The internal combustion engine herein shown is constructed basically similarly to the prior art engine illustrated in FIG. 11 and, thus, comprises a first set of cylinders or lean-mixture cylinders 10, 12 and 14 and a second set of cylinders or rich-mixture cylinders 16, 18 and 20. The lean-mixture cylinders 10, 12 and 14 are jointly connected by way of an intake manifold 22 to first mixture induction means (not shown) arranged to supply each of the cylinders 10, 12 and 14 with a combustible mixture leaner than the stoichiometric mixture (which has an air-to-fuel ratio of 14.8:1 as is well known in the art). On the other hand, the rich-mixture cylinders 16, 18 and 20 are jointly cnnected by way of an intake manifold 24 to second mixture induction means (not shown) arranged to supply each of the cylinders 16, 18 and 20 a combustible mixture richer than the stoichiometric mixture. Each of the first and second mixture induction means may comprise a carburetor or a fuel injection unit which is well known in the art. The first and second sets of cylinders are connected to first and second exhaust manifolds 26 and 28 which merge into a common exhaust re-combustion chamber 30 constituting a thermal reactor as in the prior art internal combustion engine illustrated in FIG. 1. The exhaust re-combustion chamber 10 has an outlet port 32 communicating with an exhaust pipe 34 which is led to the open air through a muffler and a tail pipe (not shown) as previously mentioned.

As is diagramatically illustrated in FIG. 3B, each of the lean-mixture cylinders 10, 12 and 14 has a bore having a diameter $D_1$ and each of the rich-mixture cylinders 16, 18 and 20 has a bore having a diameter $D_2$. The diameter $D_1$ of the bore of each of the lean-mixture cylinders 10, 12 and 14 is larger than the diameter $D_2$ of the bore of each of the rich-mixture cylinders 6, 18 and 20 by a value which will enable the former to produce a power output substantially equal to the horsepower output delivered by the latter. Thus, the bottom-dead-center volume of each of the lean-mixture cylinders 10, 12 and 14 is larger than the bottom-dead-center volume of each of the rich-mixture cylinders 16, 18 and 20 so that all the cylinders are capable of delivering substantially equal power outputs irrespective of the difference between the air-to-fuel ratios of the combustible mixtures supplied to the first and second sets of cylinders. In the embodiment illustrated in FIGS. 3A and 3B, it is assumed that the first and second sets of cylinders have piston stroke measurements which are equal to each other. It is, however, apparent that the bottom-dead-center volumes of the lean-mixture cylinders 10, 12 and 14 may be made larger than those of the rich-mixture cylinders 16, 18 and 20 by making the piston stroke measurement of each of the former larger than that of each of the latter with the bore measurements of the individual cylinders equally sized or, as an alternative, by making both of the bore and stroke measurements of each of the lean-mixture cylinders 10, 12 and 14 larger than the bore and stroke measurements of each of the rich-mixture cylinders 16, 18 and 20. No matter which arrangement may be elected, it is important that the bottom-dead-center volume of each of the lean-mixture cylinders 10, 12 and 14 be larger than the bottom-dead-center volume of each of the rich-mixture cylinders 16, 18 and 20 by a value which will enable the former to produce a horsepower output substantially equal to the power output produced by the latter.

The power output of an engine cylinder also depends upon the compression ratio which is prescribed for the cylinder. This tendency is indicated by curve *r* in FIG. 4, which shows the decrement in percentage of the power output of an engine cylinder from the value which is achieved when the compression ratio of the cylinder is set at 9:1. As will be clearly seen from the curve *r,* the power output of an engine cylinder increases as the compression ratio is increased toward 9:1. This suggests that the power outputs of the lean-mixture cylinders can be substantially equalized with the power outputs of the rich-mixture cylinders if each of the former is so arranged as to provide a compression ratio greater than the compression ratio of each of the latter. In this instance, only the compression ratio of each lean-mixture cylinder may be increased from a maximum-output producing compression ratio within the range of, for example, about 8:1 to 9:1. This will be conducive to providing an increased combustion efficiency of the lean-mixture cylinder. As an alternative, the compression ratio of each of the rich-mixture cylinders may be decreased from the maximum-output producing compression ratio with each of the lean-mixture cylinders arranged to provide the maximum-output producing compression ratio. This will be conducive to improving the exhaust cleaning performance of the thermal reactor because of the fact that the decreased compression ratio of the rich-mixture cylinders will give rise to an increase in the temperature of the exhaust gases emitted from the cylinders and is effective to promote the combustion reaction in the thermal reactor.

From the practical point of view, however, it is true that the range allowed to vary the compression ratio of an engine cylinder inherently has its limitation in enabling the engine to properly operate. If, therefore, the compression ratio of the lean-mixture cylinder is augmented with the rich-mixture cylinder arranged to provide a usually accepted compression ratio or, conversely, the compression ratio of the lean mixture cylinder is reduced with the rich-mixture cylinder arranged to provide the maximum-output producing compression ratio, it is objectionable to have the compression ratio of either the lean-mixture cylinder or the rich-mixture cylinder varied from the maximum-output producing compression ratio to such an extent as to have the power outputs of the lean-mixture and rich-mixture cylinders substantially equalized with each other. It is, for this reason, preferable that the compression ratios of both of the lean-mixture and rich-mixture cylinders be varied, viz., the compression ratio of each lean-mixture cylinder be increaseed and at the same time the compression ratio of each rich-mixture cylinder be reduced so that the power outputs of the lean mixture and rich-mixture cylinders are substantially equalized. If, however, it is positively desired for one reason or another to have the lean-mixture or rich-mixture cylinders arranged to provide a maximum-output producing compression ratio, it is preferable to have the compression ratio of the lean-mixture cylinder raised or the compression ratio of the rich-mixture cylinder lowered to such an extent that the power output of the lean-mixture cylinder is lower by approximately 20 percent than the power output of the rich-mixture cylinder because such a difference between the power outputs of the cylinders will not critically deteriorate the total performance characteristics of the engine.

To provide ease of designing and engineering the engine cylinders of the above described character, moreover, it is preferable that the compression ratio of the lean-mixture cylinder be augmented or the compression ratio of the rich-mixture cylinder reduced respectively by reducing or increasing the clearance volume of the cylinder with the piston stroke measurement of the cylinder maintained unchanged from a maximum-output producing measurement value.

As is well known in the art, the horsepower output of an engine cylinder not only varies with the bottom-dead-center volume and the compression ratio of the cylinder but depends upon the timings at which the combustible mixture is fired in the cylinder toward the end of each compression stroke of the engine. Curve *t* of FIG. 4 demonstrates the decrement, in terms of percentage, of the power output of an engine cylinder as caused when the ignition timing is retarded from the timing providing maximum engine power output, viz., from the timing which is advanced in accordance with the maximum-output producing spark-advance program, the ignition timing being indicated in terms of crankshaft rotation angles form the top dead center of a cylinder. The power output of each of the lean-mixture cylinders may therefore be made substantially equal to or at least close to the power output of each of the rich-mixture cylinders if the ignition timing set for the latter is appropriately retarded from the ignition timing set for the former. FIGS. 5A and 5B illustrate an embodiment of the present invention in which the ignition system for an internal combustion engine of the described character is constructed and arranged to put such a scheme into practice.

In FIGS. 5A and 5B, particularly in FIG. 5A, the internal combustion engine is shown to have a general construction essentially similar to that illustrated in FIG. 1 and, thus, has a set of lean-mixture cylinders 10, 12 and 14 and a set of rich-mixture cylinders 16, 18 and 20. The lean-mixture cylinders 10, 12 and 14 are jointly connected to first mixture induction means (not shown) through a common intake manifold 22 and likewise the rich-mixture cylinders 16, 18 and 20 are jointly connected to second mixture induction means (not shown) through a common intake manifold 24. The exhaust gases emitted from each of the lean-mixture cylinders 10, 12 and 14 and each of the rich-mixture cylinders 16, 18 and 20 are passed by way of exhaust manifolds 26 and 28 respectively, into a re-combustion chamber 30 as previously discussed with reference to FIG. 1. The internal combustion engine thus constructed has a spark-ignition system which comprises a first ignition unit 38 associated with the set of lean-mixture cylinders 10, 12 and 14 and a second ignition unit 38' associated with the set of rich-mixture cylinders 16, 18 and 20. The first and second ignition units 38 and 38' comprise ignition coils 40 and 40', respectively, having respective primary windings (not shown) which are jointly connected through lines 42 and 42' to a d.c. power source or storage battery 44 over an ignition switch 46. The first and second ignition units 38 and 38' further comprise ignition distributors 48 and 48', respectively. Each of the ignition distributors 48 and 48' is shown to be of the well known contact point type by way of example and thus comprises a circuit breaker assembly 50 and 50' and a distributing mechanism 52 or 52'. The circuit breaker assembly 50 or 50' includes a set of breaker points 54 and 56 or 54' and 56'. The breaker points 54 and 54' are connected to the primary windings of the ignition coils 40 and 40', respectively, while the breaker points 56 and 56' are connected to ground by lines 58 and 58', respectively. Each breaker assembly 50 or 50' further comprises and a breaker cam 60 or 60' driven from the engine camshaft (not shown) so as to cyclically bring the breaker points 54 and 56 or 54' and 56' into contact with each other. On the other hand, the distributing mechanism 52 or 52' includes a plurality of cap electrodes 62, 64 and 66 or 62', 64' and 66' and a rotor 68 or 68' which is electrically connected through a line 70 or 70' to the secondary winding (not shown) of the ignition coil 40 or 40', respectively. The rotor 68 and 68' is driven for rotation by the breaker cam 60 or 60' and connects the cap electrodes 62, 64 and 66 or 62', 64' and 66' in succession to the secondary winding of the ignition coil 40 or 40', respectively. The cap electrodes 62, 64 and 66 of the distributor 48 of the first ignition unit 38 are connected through lines 72, 74 and 76 to spark plugs 78, 80 and 82, respectively, and likewise the cap electrodes 62', 64' and 66' of the distributor 48' of the second ignition unit 38' are connected through lines 72', 74' and 76' to spark plugs 78', 80' and 82', respectively. The spark plugs 78, 80 and 82 of the first ignition unit 38 are mounted on the lean-mixture cylinders 10, 12 and 14 and the spark plugs 78', 80' and 82' of the second ignition unit 38' are mounted on the rich-mixture cylinders 16, 18 and 20 of the internal combustion engine shown in FIG. 5A.

The distributor 48 of the first ignition unit 38 has incorporated thereinto spark-advance means (not shown) arranged to provide usually accepted spark-advance characteristics enabling each of the lean-mixture cylinders 10, 12 and 14 to produce maximum power output depending upon the engine speed and the load exerted on the engine. On the other hand, the distributor 48' of the second ignition unit 38' has incorporated thereinto spark-advance means (not shown) arranged to provide ignition timings which are retarded from the ignition timings conforming to the usually accepted spark-advance characteristics prescribed for the distributor 48 of the first ignition unit 38. The spark-advance means thus incorporated into each of the distributors 48 and 48' of the first and second ignition units 38 and 38' may comprise a spark-advance mechanism responsive to engine speed and spark-advance mechanism responsive to vacuum developed in each of the intake manifolds 22 and 24, as is usually the case with an ordinary spark ignition system of an internal combustion engine.

Figure 4:
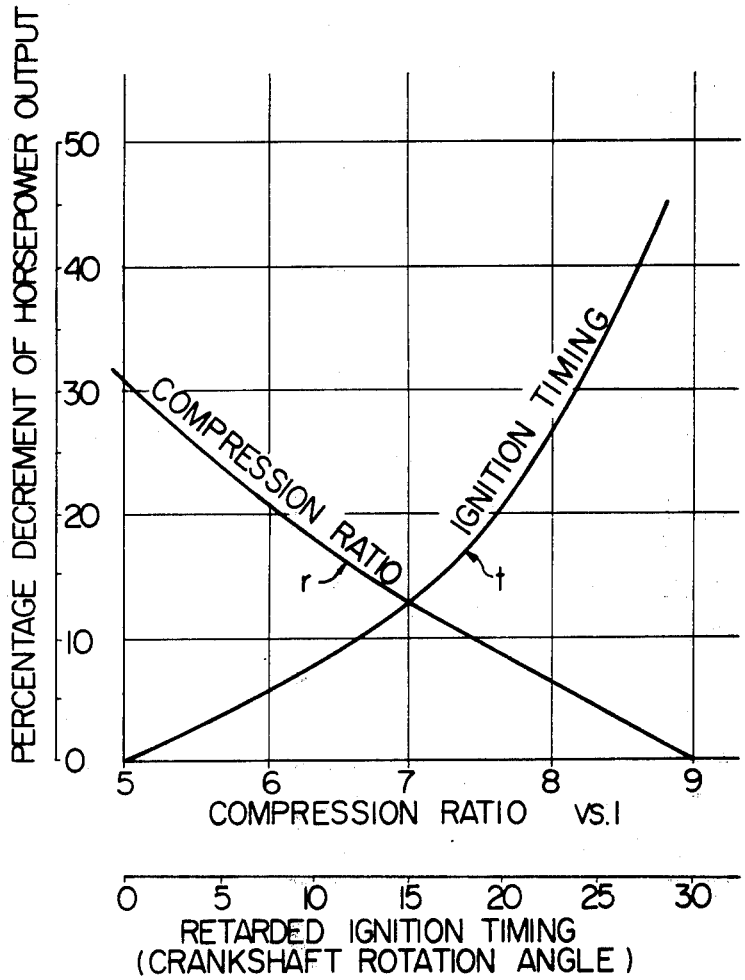
FIG. 4 is a graph showing general tendencies of variation of the decrements in percentage of the horsepower output of an engine cylinder in respect of the compression ratio of the cylinder (indicated by curve *r*) and the crankshaft rotation angle retarded from the ignition timing advanced to provide maximum engine output (indicated by curve *t*)
Figure 5A:
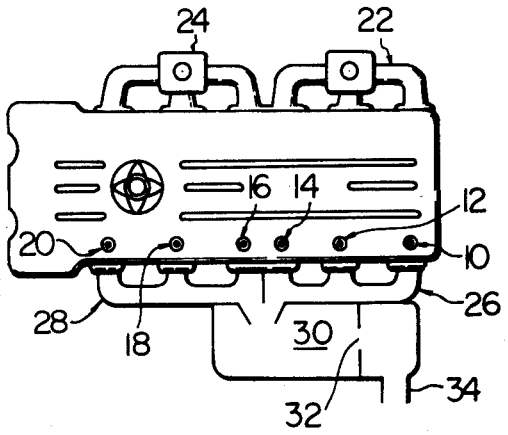
FIG. 5A is a view similar to FIG. 3A but shows a multiple-cylinder internal combustion engine incorporating another improvement according to the present invention.
Figure 5B:
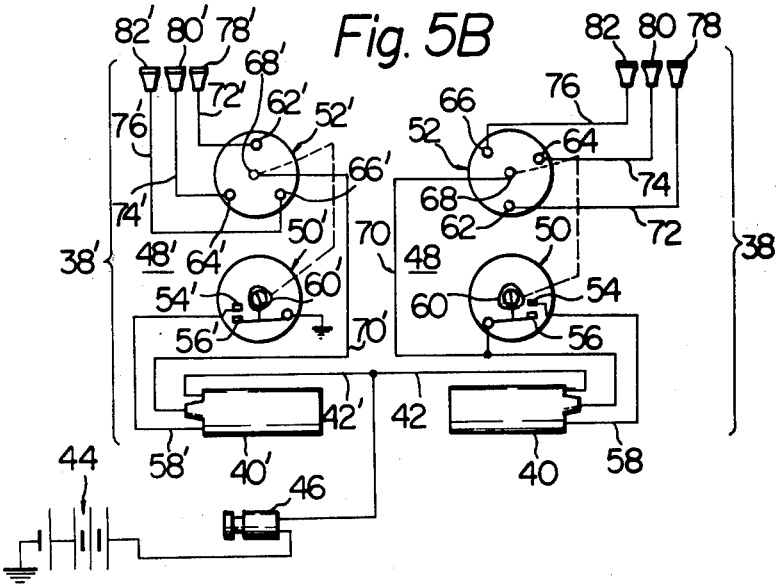
FIG. 5B is a schematic view showing a general arrangement of the ignition system of the internal combustion engine illustrated in FIG. 5A.

The ignition timings achieved in each of the rich-mixture cylindrs 16, 18 and 20 are, thus, retarded from those which are achieved in each of the lean-mixture cylinders 10, 12 and 14 so that the power output produced by the former is lowered and substantially equalized with or at least made close to the power output of the latter as will be understood from the characteristics indicated by the curve *t* of FIG. 4. Retarding the ignition timings of the rich-mixture cylinders 16, 18 and 20 to such an extent as to make the power output of each of the rich-mixture cylinders substantially equalized with the power output of each of the lean-mixture cylinders 16, 18 and 20 would, however, result in critical deterioration of the thermal efficiency of the rich-mixture cylinders 16, 18 and 20 and would consequently impair the practical feasibility of the engine as a whole. It is, for this reason, preferable that the ignition timings of the rich-mixture cylinders 16, 18 and 20 be retarded from the usually accepted ignition timings to such an extent as to make the power output of each of the lean-mixture cylinders 10, 12 and 14 lower by approximately 20 per cent than the horsepower output of each of the rich-mixture cylinders 16, 18 and 20 because such a difference between the power outputs is allowable from practical purposes as previously noted. If, therefore, the combustible mixture supplied to the lean-mixture cylinders 10, 12 and 14 is proportioned to have an air-to-fuel ratio of 19.5;1 and the combustible mixture supplied to the rich-mixture cylinders 16, 18 and 20 is proportioned to have an air-to-fuel ratio of 11.5:1 so that the power output of the former is approximately 44 percent lower than the horsepower output of the latter and if the ignition timing of each of the rich-mixture cylinders 16, 18 and 20 is retarded by approximately 20° of crankshaft rotation from the ignition timing providing maximum engine power output, viz., from the ignition timing set on each of the lean-mixture cylinders 10, 12 and 14, then the resultant difference between the power outputs of the lean-mixture and rich-mixture cylinders will amount to approximately 20 percent of the power output of each rich-mixture cylinder. Retarding the ignition timing by approximately 20° of crankshaft rotation is, moreover, within a range which is practically allowable to enable the engine to operate properly.

In each of the embodiments of the present invention thus far described, it has been assumed that the power outputs of the lean-mixture and rich-mixture cylinders are equalized or at least made closer to each other by varying the bottom-dead-center volumes, compression ratios or spark-ignition timings of the lean-mixture and/or rich-mixture cylinders of the engine. In view, however, of the restrictions practically imposed on these parameters, it will be difficult to provide completely satisfactory results if only one of such schemes is realized in the engine. As a matter of fact, the power output of the lean-mixture and rich-mixture cylinders could be substantially equalized or at least made close to each other more easily if both of the bottom-dead-center volumes and compression ratios, the compression ratios and ignition timings, or the ignition timings and bottom-dead-center volumes of the cylinders or all of these parameters are adjusted in combination. From the viewpoint of controlling the exhaust emission, it is particularly preferable to lower the compression ratio and at the same time retard the ignition timing of each of the rich-mixture cylinders because such arrangements will contribute to suppressing the formation of nitrogen oxides in the combustion chamber of the cylinder and to raising the temperature of the exhaust gases from the cylinder so that the unburned hydrocarbons and carbon monoxide contained in the exhaust gases are efficiently re-combusted in the thermal reactor. Adjustment of both of the compression ratios and the ignition timings of the engine cylinders is, thus, conducive not only to equalizing the power outputs of the cylinders but to reducing the noxious exhaust emissions of the cylinders. For this reason, it is further preferable that the combustible mixture supplied to the rich-mixture cylinders arranged in the above described fashion be proportioned to an air-to-fuel ratio of a leaner side of the previously mentioned range of from about 10:1 to 13:1, viz., to an air-to-fuel ratio within the range of from about 12:1 to 13:1. Lowering the compression ratio and retarding the ignition timing of an engine cylinder in general will invite substantial reduction in the thermal efficiency of the cylinder but, from an exhaust cleaning standpoint, such a problem will be offset by the above mentioned benefits. The reduction in the thermal efficiency will be alleviated if the combustible mixture supplied to the rich-mixture cylinders is proportioned to an air-to-fuel ratio within the range of 12:1 to 13:1 as above mentioned.

The advantages achieved by the present invention will be exploited most effectively if all of the previously mentioned parameters, viz., the bottom-dead-center volumes, the compression ratios and the ignition timings of the cylinders are adjusted in such a manner that will make the power outputs of the lean-mixture and rich-mixture cylinders substantially equal or at least closer to each other. If, in this instance, the lean-mixture cylinders are supplied with a combustible mixture having an air-to-fuel ratio of 19.5:1 and the rich-mixture cylinders are supplied with a combustible mixture having an air-to-fuel ratio of 11.5:1 then the power output of each of the lean-mixture cylinders is lower by approximately 44 percent than the horsepower output of each of the rich-mixture cylinders as previously mentioned with reference to FIG. 2. If, on top of this, arrangement is made so that each of the lean-mixture cylinders provides a compression ratio of 9:1 and an ignition timing producing maximum engine power output and each of the rich-mixture cylinders provides a compression ratio of 7:1 and an ignition timing retarded by approximately 10 degrees of crankshaft rotation from the ignition timing providing the maximum engine power output, then the power output of each of the rich-mixture cylinders becomes lower by approximately 29 percent than the power output of each of the lean-mixture cylinders, as will be understood from the curves *r* and *t* of FIG. 4. The resultant difference between the power outputs of each of the lean-mixture cylinders and each of the rich-mixture cylinders thus amounts to approximately 15 percent of the power output of each rich-mixture cylinder. Such a difference will be compensated for if the bottom-dead-center volume of each of the lean-mixture cylinders is increased approximately 15 percent. In a usual six-cylinder engine having a cylinder bore of 78 millimeters and a piston stroke of 69.7 millimeters, the total piston displacement of the engine amounts to 1988 cu. cm so that the piston displacement per cylinder is approximately 331 cu. cm. If, thus, each of the rich-mixture cylinders has a bottom-dead-center volume of 331 cu. cm, then each of the lean-mixture cylinders should be designed to have a bottom-dead-center volume of approximately 382 cu. cm so that the bottom-dead-center volume of the latter is greater by approximately 15 percent than the bottom-dead-center volume of the former. Assuming, in this instance, that all the engine cylinders have equal piston stroke measurements, each of the lean-mixture cylinders should be sized to have a cylinder bore of approximately 83.6 millimeters which is greater by approximately 5.6 millimeters than the cylinder bore of each of the rich-mixture cylinders. The cylinder bore of each of the lean-mixture cylinders is thus greater by approximately 7 percent than that of each of the rich-mixture cylinders so that the ratio between the cylinder bore measurements of each of the lean-mixture cylinders and each of the rich-mixture cylinders is approximately 1.07:1.00.

While the internal combustion engine embodying the present invention has been assumed and illustrated in the drawings as having six in-line cylinders, the improvements according to the present invention may be incorporated into any other types of multiple-cylinder internal combustion engines such as engines having four, eight, twelve or sixteen cylinders of the in-line, V-type, X-type or the like insofar as the cylinders are arranged in a first group operating on a relatively lean air-fuel mixture and a second group operating on a relatively rich air-fuel mixture.

What is claimed is:

1. A spark-ignition multiple-cylinder internal combustion engine having a first set of cylinders connected to first mixture induction means operative to supply each of said first set of cylinders with a combustible mixture leaner than a stoichiometric mixture, a second set of cylinders connected to second mixture induction means operative to supply each of said second set of cylinders with a combustible mixture richer than the stoichiometric mixture, an exhaust system including exhaust re-combustion means for re-combusting the mixture of the exhaust gases from the first and second sets of cylinders, and a spark-ignition system comprising first and second ignition units respectively connected with said first and second sets of cylinders, wherein the first ignition unit is arranged to provide spark-advance characteristics enabling each of the first set of cylinders to produce a power output approximating maximum power output of the cylinder and the second ignition unit is arranged to provide spark-advance characteristics producing ignition timing retarded from ignition timing dictated by spark-advance characteristics which will provide maximum power output of each of the second set of cylinders.

2. An internal combustion engine as set forth in claim 1, in which the spark-advance characteristics of said first and second ignition units are selected in such a manner that the power output of each of said first set of cylinders becomes lower by approximately 20 percent lower than the power output of each of said second set of cylinders.

3. A spark-ignition multiple-cylinder internal combustion engine as set forth in claim 1 wherein each of said first set of cylinders has a bottom-dead-center volume which is larger than the bottom-dead-center volume of each of said second set of cylinders.

4. An internal combustion engine as set forth in claim 3, in which each of said first set of cylinders is larger in cylinder bore measurement than each of said second set of cylinders.

5. An internal combustion engine as set forth in claim 3, in which each of said first set of cylinders is larger in piston stroke measurement than each of said second set of cylinders.

6. An internal combustion engine as set forth in claim 3, in which each of said first set of cylinders is larger in cylinder bore and piston stroke measurements than each of said second set of cylinders.

7. A spark-ignition multiple-cylinder internal combustion engine as set forth in claim 1, wherein said first and second sets of cylinders are constructed and arranged so that each of the first set of cylinders has a compression ratio higher than the compression ratio of each of the second set of cylinders.

8. An internal combustion engine as set forth in claim 7, in which each of said first set of cylinders has a stroke measurement substantially equal to the stroke measurement of each of said second set of cylinders and has a clearance volume smaller than the clearance volume of each of the second set of cylinders.

9. An internal combustion engine as set forth in claim 7, in which each of said first set of cylinders is arranged to provide a predetermined maximum-output producing compression ratio and each of said second set of cylinders is arranged to provide a compression ratio lower than said predetermined maximum-output producing compression ratio.

10. An internal combustion engine as set forth in claim 7, in which each of said second set of cylinders is arranged to provide a predetermined maximum-output producing compression ratio and each of said first set of cylinders is arranged to provide a compression ratio higher than said predetermined maximum-output producing compression ratio.

11. An internal combustion engine as set forth in claim 7, in which each of said first set of cylinders is arranged to provide a compression ratio higher than a predetermined maximum-output producing compression ratio and each of said second set of cylinders is arranged to provide a compression ratio lower than said predetermined maximum-output producing compression ratio.

12. An internal combustion engine as set forth in claim 7, in which the compression ratios of each of said first set of cylinders and each of said second set of cylinders are selected in such a manner that the power output of the former is lower than the power output of the latter and that the difference therebetween is less than approximately 20 percent of the latter.

13. An internal combustion engine as set forth in claim 7, in which said second mixture induction means is arranged to supply each of said second set of cylinders with a combustible mixture having an air-to-fuel ratio within the range of from about 12:1 to about 13:1.

14. A spark-ignition multiple-cylinder internal combustion engine having a first set of cylinders connected to first mixture induction means operative to supply each of said first set of cylinders with a combustible mixture leaner than a stoichiometric mixture, a second set of cylinders connected to second mixture induction means operative to supply each of said second set of cylinders with a combustible mixture richer than the stoichiometric mixture, an exhaust system including exhaust re-combustion means for re-combusting the mixture of the exhaust gases from the first and second sets of cylinders, and a spark-ignition system comprising first and second ignition units which are respectively connected with said first and second sets of cylinders, wherein said first and second sets of cylinders are constructed and arranged in such a manner that each of the first sets of cylinders has a bottom-dead-center volume larger than and a compression ratio higher than those of each of said second set of cylinders and wherein said first ignition unit is arranged to provide spark-advance characteristics enabling each of the first set of cylinders to produce a power output approximating maximum power output of the cylinder and said second ignition unit is arranged to provide spark-advance characteristics producing ignition timing which is retarded from the ignition timing dictated by spark-advance characteristics which will provide maximum power output of each of said second set of cylinders.

* * * * *